US009262961B2

(12) United States Patent
Shih et al.

(10) Patent No.: US 9,262,961 B2
(45) Date of Patent: Feb. 16, 2016

(54) PIXEL ARRANGEMENT OF COLOR DISPLAY APPARATUS

(71) Applicant: AU Optronics Corporation, Hsinchu (TW)

(72) Inventors: Li-Wei Shih, Hsinchu (TW); Yiyo Dai, Hsinchu (TW); Tse-Chin Chen, Hsinchu (TW); Hsueh-Yen Yang, Hsinchu (TW)

(73) Assignee: AU OPTRONICS CORPORATION, Hsinchu (TW)

( * ) Notice: Subject to any disclaimer, the term of this patent is extended or adjusted under 35 U.S.C. 154(b) by 120 days.

(21) Appl. No.: 14/015,686

(22) Filed: Aug. 30, 2013

(65) Prior Publication Data

US 2015/0061978 A1 Mar. 5, 2015

(51) Int. Cl.
*G09G 3/32* (2006.01)

(52) U.S. Cl.
CPC ..... *G09G 3/3225* (2013.01); *G09G 2300/0452* (2013.01)

(58) Field of Classification Search
CPC .... G09G 3/3607; G09G 3/364; G09G 3/3644
USPC ..... 345/76
See application file for complete search history.

(56) References Cited

U.S. PATENT DOCUMENTS

| | | | | |
|---|---|---|---|---|
| 6,867,549 | B2 | 3/2005 | Cok et al. | |
| 8,330,352 | B2 | 12/2012 | Sung et al. | |
| 2003/0128179 | A1* | 7/2003 | Credelle | 345/88 |
| 2004/0108818 | A1* | 6/2004 | Cok et al. | 315/169.3 |
| 2005/0151752 | A1* | 7/2005 | Phan | 345/589 |
| 2012/0092238 | A1 | 4/2012 | Hwang et al. | |

* cited by examiner

*Primary Examiner* — Premal Patel
(74) *Attorney, Agent, or Firm* — Tim Tingkang Xia, Esq.; Locke Lord LLP

(57) ABSTRACT

A color display apparatus includes pixels P(i, j) arranged in a matrix having M columns and N rows, where i=1, 2, . . . , M, j=1, 2 . . . , N. A plurality of pixel pairs is defined along either the columns or the rows. Each pixel pair includes one pixel P(i, j) and the next immediate pixel, where if i is an odd integer, j is an odd integer, and if i is an even integer, j is an even integer. Each pixel pair has a first subpixel configured to display a first color and symmetrically positioned across the pixels, a pair of second subpixels configured to display a second color and symmetrically positioned in the pixels respectively, and a pair of third subpixels configured to display a third color and symmetrically positioned in the pixels respectively. The first subpixel is positioned between the pair of second subpixels.

18 Claims, 12 Drawing Sheets

PIXEL ARRANGEMENT OF COLOR DISPLAY APPARATUS

FIELD OF THE DISCLOSURE

The disclosure relates generally to display technology, and more particularly to color display apparatuses and pixel arrangements thereof.

BACKGROUND OF THE DISCLOSURE

Currently, active-matrix organic light-emitting diodes (AMOLEDs) are widely used as display devices. The AMOLED is a high effective display device, which has the advantages of being operable under relatively low temperature, using low voltage, and having fast responsive time, and is capable of commercial production of large sized and wide viewing angle display devices.

A typical color AMOLED generally adopts the RGB color model, which is configured to display a broad array of colors by mixing the three primary colors of red (R), green (G) and blue (B). Generally, the AMOLED includes a plurality of pixels formed in a matrix, where each pixel has three subpixels. Each subpixel represents an emitting area which is configured to display one of the RGB colors, and is separate from one another to avoid color mixing issues.

Generally, the subpixels may be manufactured by evaporation deposition using a shadow mask. Specifically, the shadow mask is positioned under a thin-film transistor (TFT) substrate such that subpixel materials of each RGB color may be deposited by evaporation on the position of the subpixels to form the subpixels. However, evaporation deposition is a high temperature process where heat is generated during manufacturing of the subpixels, and the shadow mask may deform during the manufacturing process due to thermal expansion and gravity. Thus, positioning accuracy of the shadow mask is difficult, which limits the accurate positioning of the subpixels within each pixel. The limitation creates a minimum threshold for the size of the pixels, and further limits the pixel per inch (PPI) of the AMOLED.

Therefore, a heretofore unaddressed need exists in the art to address the aforementioned deficiencies and inadequacies.

SUMMARY OF THE DISCLOSURE

In one aspect, the disclosure relates to a color display apparatus. In one embodiment, the color display apparatus includes: a plurality of pixels P(i, j) arranged in a matrix having M columns and N rows, where i=1, 2, . . . , M, j=1, 2 . . . , N, and M and N are positive integers. The i-th column of the matrix defines a plurality of pixel pairs, and each pixel pair includes two pixels P(i, j) and P(i, j+1), where if i is an odd integer, j is an odd integer, and if i is an even integer, j is an even integer. Each pixel pair has five subpixels, including a first subpixel configured to display a first color and symmetrically positioned across the pixels P(i, j) and P(i, j+1), a pair of second subpixels configured to display a second color and symmetrically positioned in the pixels P(i, j) and P(i, j+1), respectively, and a pair of third subpixels configured to display a third color and symmetrically positioned in the pixels P(i, j) and P(i, j+1), respectively, where the first subpixel is positioned between the pair of second subpixels.

In one embodiment, the color display apparatus is a color active-matrix organic light-emitting diode (AMOLED).

In one embodiment, for each pixel pair: the first subpixel has a first length along the column and a first width along the row; each second subpixel has a second length along the column and a second width along the row, where the second length is shorter than the first length; and each third subpixel has a third length along the column and a third width along the row, where the third length is greater than the second length.

In one embodiment, if i is an even integer, a first pixel P(i, 1) and a last pixel P(i, N) of the i-th column each has three subpixels, including the first subpixel positioned at an edge of the matrix, the second subpixel, and the third subpixel.

In another aspect, the disclosure relates to a color display apparatus. In one embodiment, the color display apparatus includes: a plurality of pixels P(i, j) arranged in a matrix having M columns and N rows, where i=1, 2, . . . , M, j=1, 2 . . . , N, and M and N are positive integers. The j-th row of the matrix defines a plurality of pixel pairs, and each pixel pair includes two pixels P(i, j) and P(i+1, j), where if j is an odd integer, i is an odd integer, and if j is an even integer, i is an even integer. Each pixel pair has five subpixels, including a first subpixel configured to display a first color and symmetrically positioned across the pixels P(i, j) and P(i+1, j), a pair of second subpixels configured to display a second color and symmetrically positioned in the pixels P(i, j) and P(i+1, j), respectively, and a pair of third subpixels configured to display a third color and symmetrically positioned in the pixels P(i, j) and P(i+1, j), respectively, where the first subpixel is positioned between the pair of second subpixels.

In one embodiment, the color display apparatus is a color active-matrix organic light-emitting diode (AMOLED).

In one embodiment, for each pixel pair: the first subpixel has a first length along the row and a first width along the column; each second subpixel has a second length along the row and a second width along the column, where the second length is shorter than the first length; and each third subpixel has a third length along the row and a third width along the column, where the third length is greater than the second length.

In one embodiment, if j is an even integer, a first pixel P(1, j) and a last pixel P(M, j) of the j-th row each has three subpixels, including the first subpixel positioned at an edge of the matrix, the second subpixel, and the third subpixel.

In one embodiment, the first color is blue, the second color is green, and the third color is red.

In one embodiment, the first color is blue, the second color is red, and the third color is green.

In one embodiment, the first color is red, the second color is green, and the third color is blue.

In one embodiment, the first color is red, the second color is blue, and the third color is green.

In one embodiment, the first color is green, the second color is blue, and the third color is red.

In one embodiment, the first color is green, the second color is red, and the third color is blue.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION OF THE DISCLOSURE

Figure 1A:
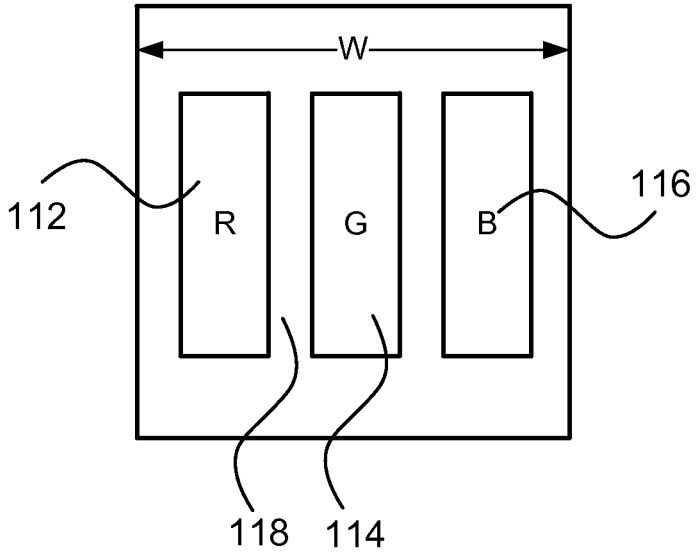
FIG. 1A shows schematically a plain view of a color pixel of a color display apparatus having a stripe RGB arrangement according to one comparative embodiment of the disclosure.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top", and "left" and "right", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the present disclosure in conjunction with the accompanying drawings in FIGS. 1-10. In accordance with the purposes of this disclosure, as embodied and broadly described herein, this disclosure, in one aspect, relates to a color display apparatus having a particular color subpixel arrangement.

FIG. 1A shows schematically a plain view of a color pixel of a color display apparatus having a stripe RGB arrangement according to one comparative embodiment of the disclosure. As discussed above, the color display apparatus adopts the RGB color model, which is configured to display a broad array of colors by mixing the three primary colors of red (R), green (G) and blue (B). The pixel 110 is formed on a TFT substrate (not shown in FIG. 1A), and has three subpixels 112, 114 and 116. Each of the subpixels 112, 114 and 116 is in a stripe shape parallel to one another, and represents an emitting area which is configured to display one of the RGB colors. As shown in FIG. 1A, for example, the subpixel 112 is configured to display the red color, the subpixel 114 is configured to display the green color, and the subpixel 116 is configured to display the blue color. Further, the subpixels 112, 114 and 116 are separate from one another, forming an error proof area 118 around the subpixels 112, 114 and 116, such that color mix issues may be prevented. The size of the subpixels 112, 114 and 116 and the size of the error proof area 118 determine the overall size of the pixel 110, such as the width W of the pixel 110.

Figure 1B:
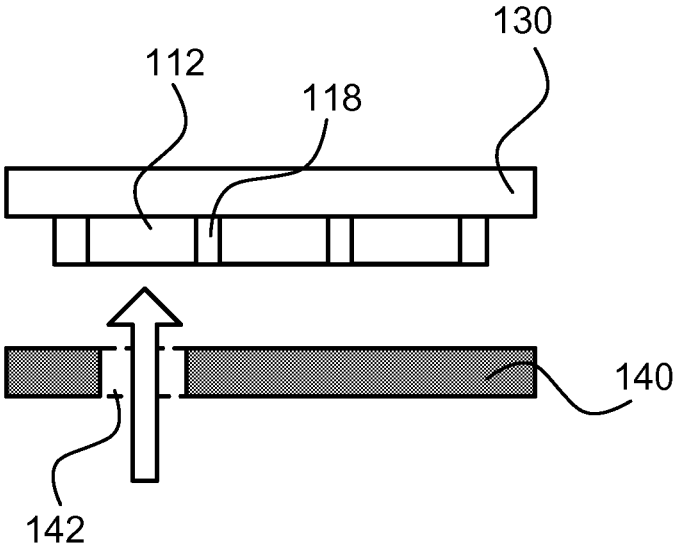
FIG. 1B shows schematically a side view of the color pixel during an evaporation deposition process according to one embodiment of the disclosure.

FIG. 1B shows schematically a side view of the color pixel during an evaporation deposition process according to one embodiment of the disclosure. Generally, the pixel may be manufactured by the shadow mask technology. By using a shadow mask 140 positioned under the substrate 130, evaporation deposition may be performed to deposit the subpixel materials on the TFT substrate at the position of each subpixel 112. For example, FIG. 1B shows the evaporation deposition of the subpixel 112, where the shadow mask 140 has a hole 142 positioned under the TFT substrate 130 which corresponds to the position of the subpixel 112, such that evaporated subpixel material may pass through the hole 142 (as shown by the arrow) to be deposited on the TFT substrate 130. The shape of the hole 142 corresponds to the shape of the subpixel 112.

However, as discussed above, positioning accuracy of the shadow mask 140 is essential for the performance of the shadow mask technology, and the shadow mask may deform during the manufacturing process due to thermal expansion and gravity. Thus, a tension may be applied to the shadow mask to ensure the positioning of the shadow mask.

Figure 1C:
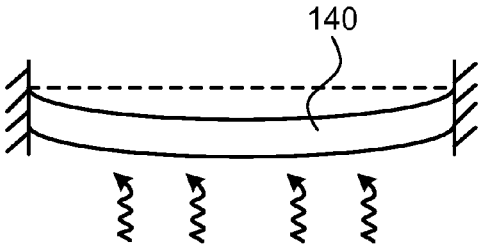
FIG. 1C shows schematically the shadow mask without tension according to one embodiment of the disclosure.
Figure 1D:
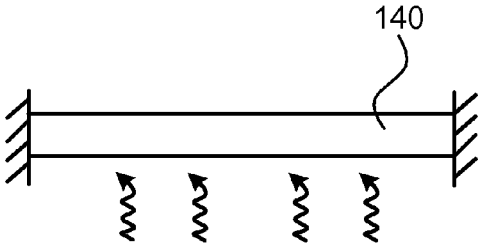
FIG. 1D shows schematically the shadow mask with tension according to one embodiment of the disclosure.

FIG. 1C shows schematically the shadow mask without tension and FIG. 1D shows schematically the shadow mask with tension. As shown in FIG. 1C, the shadow mask 140 without tension may deform downwards during the manufacturing process due to thermal expansion and gravity. Thus, the position of the hole 142 (not shown in FIG. 1C) may be deviated to affect the position of the subpixels being manufactured. Although the deformation of the shadow mask 140 may be compensated by applying a tension, as shown in FIG. 1D, the deviation error of the subpixel exists due to the stripe shapes of the subpixels 112, 114 and 116. Thus, the size of the error proof area 118 between each two adjacent subpixels must be greater than a certain size to avoid color mixing issues.

Figure 1E:
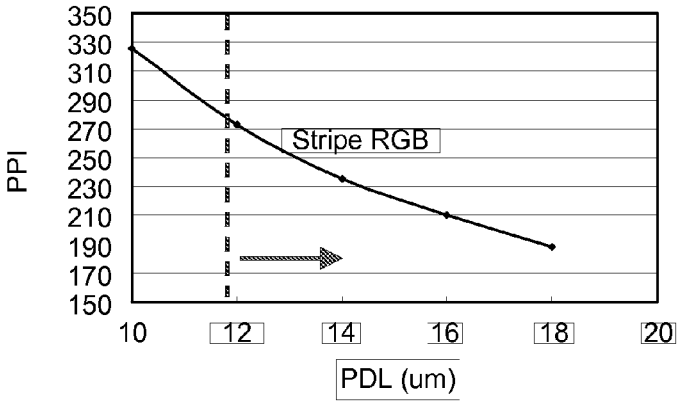
FIG. 1E shows a pixel per inch (PPI)-pixel defining layer (PDL) relationship of the color pixel of FIG. 1A according to one comparative embodiment of the disclosure.

FIG. 1E shows a PPI-PDL relationship of the color pixel of FIG. 1A according to one comparative embodiment of the disclosure. As shown in FIG. 1E, the increase of the width of PDL results in decrease of the PPI. In the actual manufacturing process, a realistic PDL of about 12 μm would have a PPI threshold of about 270 PPI, which becomes a threshold of the high resolution AMOLED panels.

Thus, one aspect of the disclosure relates to a color display apparatus, which has a new subpixel arrangement to allow high PPI under the same PDL requirement.

Figure 2:
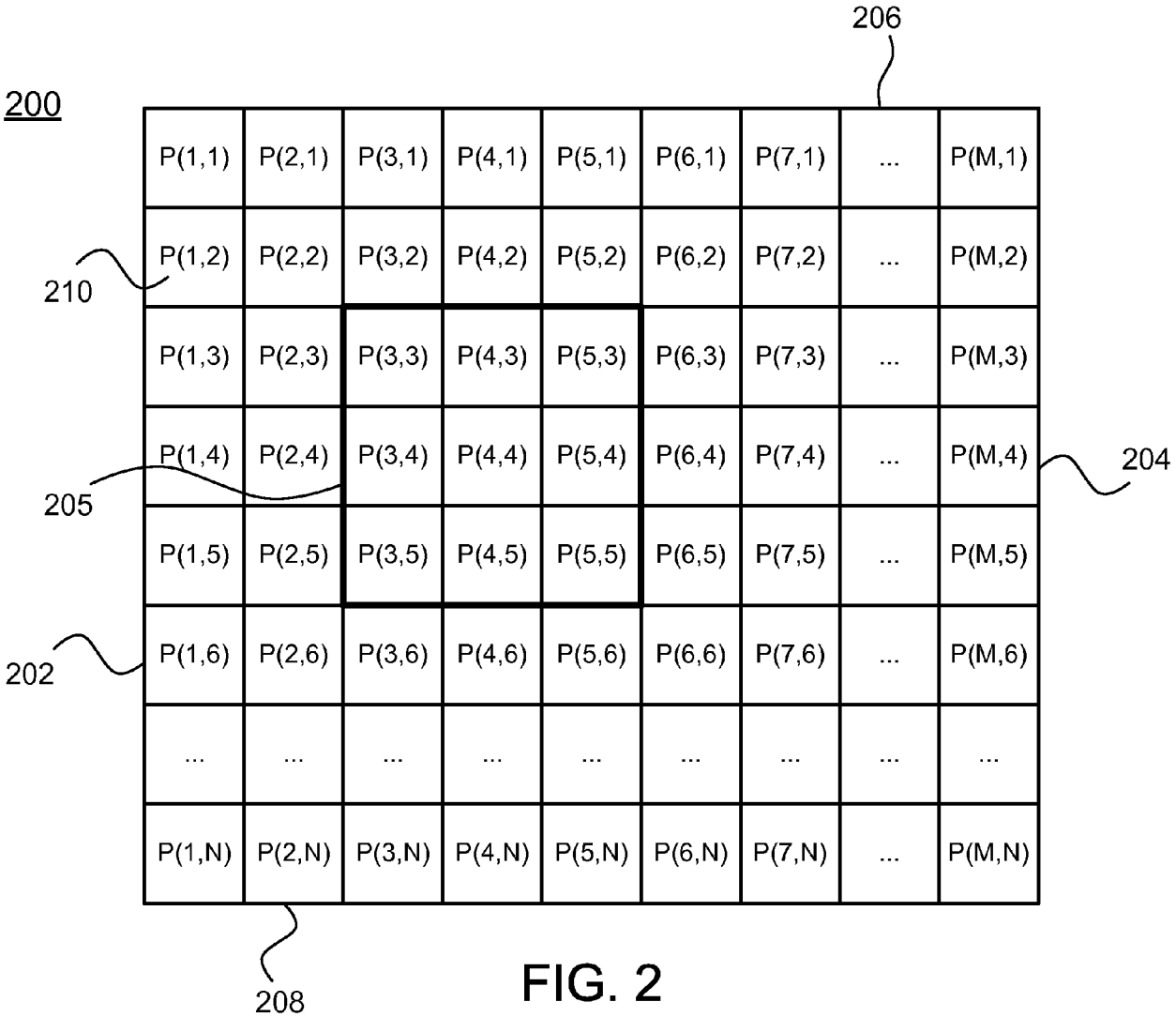
FIG. 2 shows schematically the pixel arrangement of a color display apparatus according to one embodiment of the disclosure.

FIG. 2 shows schematically the pixel arrangement of a color display apparatus according to one embodiment of the disclosure. As shown in FIG. 2, the color display apparatus includes a plurality of pixels 210 arranged in a matrix 200 having M columns and N rows, where M and N are positive integers. Each pixel 210 is denoted as P(i, j), where i=1, 2, . . . , M, and j=1, 2 . . . , N. For example, the pixel P(1,1) refers to the pixel at the first row and the first column of the matrix. Further, the matrix includes four edges 202, 204, 206 and 208.

Figure 3B:
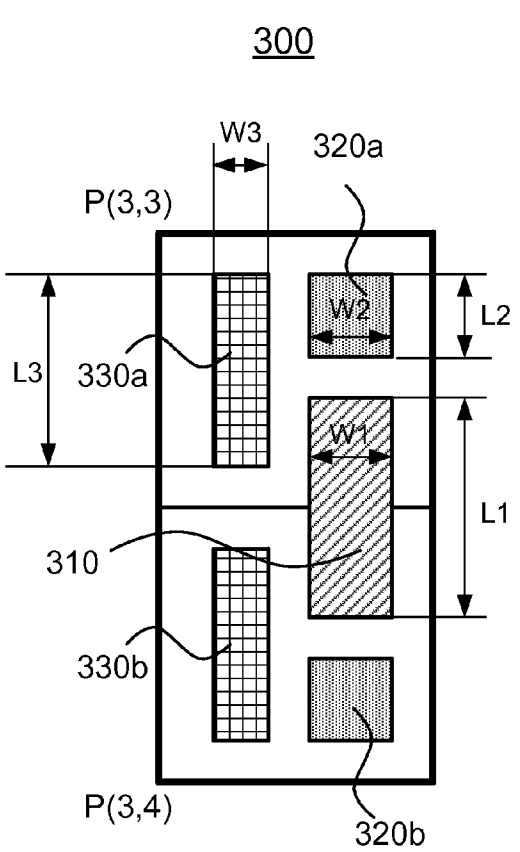
FIG. 3B shows schematically a pixel pair according to one embodiment of the disclosure.
Figure 3A:
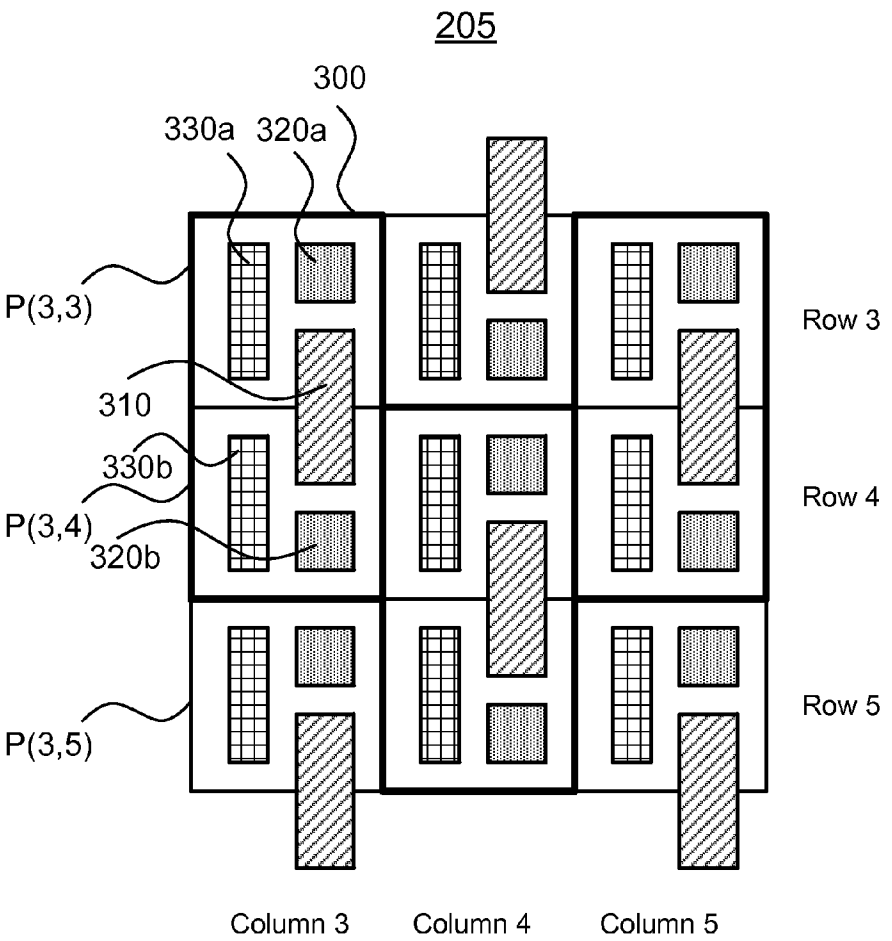
FIG. 3A shows schematically a 3×3 matrix of the pixels according to one embodiment of the disclosure.

To further describe the subpixel arrangement, a 3×3 matrix portion 205 of FIG. 2 is shown in FIG. 3A. The 3×3 matrix 205 includes the nine pixels P(3,3), P(3,4), P(3,5), P(4,3), P(4,4), P(4,5), P(5,3), P(5,4) and P(5,5). As shown in FIG. 3A, the i-th column of the matrix defines a plurality of pixel pairs 300, and each pixel pair 300 includes a starting pixel P(i, j) and the immediate next pixel P(i, j+1). For the starting pixel, if i is an odd integer, j is an odd integer, and if i is an even integer, j is an even integer. Specifically, for each odd column, the starting pixel of each pixel pair 300 would be in an odd row, and for each even column, the starting pixel of each pixel pair would be in an even row. For example, in column 3, which is an odd column, i=3. Thus, a pixel pair 300 is defined to include the starting pixel P(3,3) and the immediate next pixel P(3,4), where the starting pixel P(3,3) is in an odd row. Similarly, the pixel P(3,5) would be the starting pixel of another pixel pair (not shown) with the pixel P(3,6) (not shown in FIG. 3A). On the other hand, in column 4, which is an even column, i=4. Thus, another pixel pair (shown in bold line) is defined to include the starting pixel P(4,4) and the immediate next pixel P(4,5), where the starting pixel P(4,4) is in an even row. Further, in column 5 (i=5), which is an odd column, another pixel pair (shown in bold line) is defined to include the starting pixel P(5,3) and the immediate next pixel P(5,4), where the starting pixel P(5,3) is in an odd row. In other words, the pixel pairs of adjacent column are alternatively positioned, such that the two pixels of the pixel pair are respectively adjacent to pixels of two different pixel pairs in the adjacent column.

FIG. 3B shows schematically the pixel pair 300 including the pixels P(3,3) and P(3,4) as an example. As shown in FIG. 3B, the pixel pair 300 has five subpixels, including a first subpixel 310, a pair of second subpixels 320*a* and 320*b*, and a pair of third subpixels 330*a* and 330*b*. In the pixel pair 300, the subpixels are positioned symmetrically. The first subpixel 310 is configured to display a first color, and is symmetrically positioned across the pixels P(3,3) and P(3,4). The second subpixels 320*a* and 320*b* are configured to display a second color, and are symmetrically positioned in the pixels P(3,3) and P(3,4), respectively. The third subpixels 330*a* and 330*b* are configured to display a third color, and are symmetrically positioned in the pixels P(3,3) and P(3,4), respectively. The first subpixel 310 is positioned between the pair of second subpixels 320*a* and 320*b*. Thus, the first subpixel 310 is substantially aligned to the second subpixels 320*a* and 320*b*.

Further, for the pixel pair 300, each subpixel has a length along the column and a width along the row. Specifically, the first subpixel 310 has a first length L1 along the column and a first width W1 along the row. Each of the second subpixels 320*a* and 320*b* has a second length L2 along the column and a second width W2 along the row, where the second length L2 is shorter than the first length L1. Each of the third subpixels 330*a* and 330*b* has a third length L3 along the column and a third width W3 along the row, where the third length L3 is greater than the second length L2.

It should be appreciated that in each pixel pair 300, the first subpixel 310 is symmetrically positioned across the pixels P(i, j) and P(i, j+1) of the pixel pair 300. Since the pixel pairs 300 of adjacent column are alternatively positioned, the first subpixel 310 of one pixel pair 300 would not align to the first subpixel 310 of another pixel pair 300 in the adjacent column. Similarly, the second subpixels 320*a* and 320*b* of one pixel pair 300 would not align to the second subpixels 320*a* and 320*b* of another pixel pair 300 in the adjacent column.

Figure 3C:
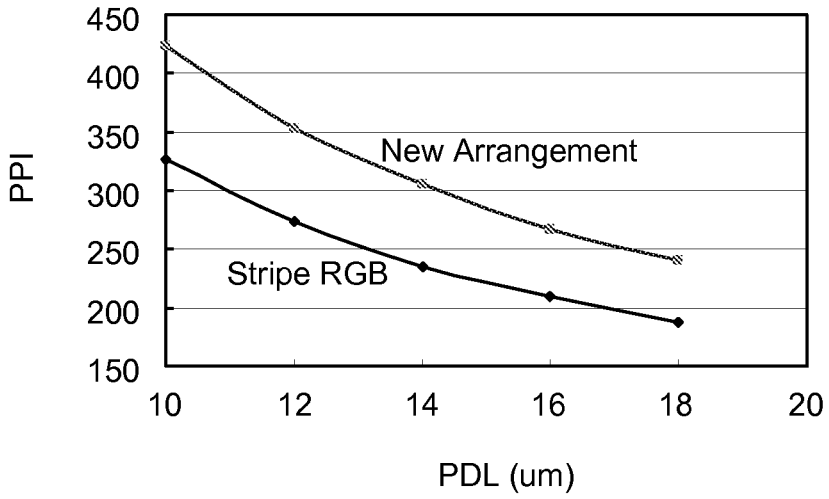
FIG. 3C shows a PPI-PDL relationship of the pixels of FIG. 3A according to one embodiment of the disclosure.

FIG. 3C shows a PPI-PDL relationship of the pixels of FIG. 3A according to one embodiment of the disclosure. As described above, the increase of PDL results in decrease of the PPI. For the stripe shaped subpixels, a realistic PDL of about 12 μm would have a PPI threshold of about 270 PPI. However, the new subpixel arrangement allows the PPI threshold to reach about 350 PPI when the PDL remains about 12 μm. Thus, the increase of the PPI threshold allows higher resolution to be achieved.

Figure 4A:
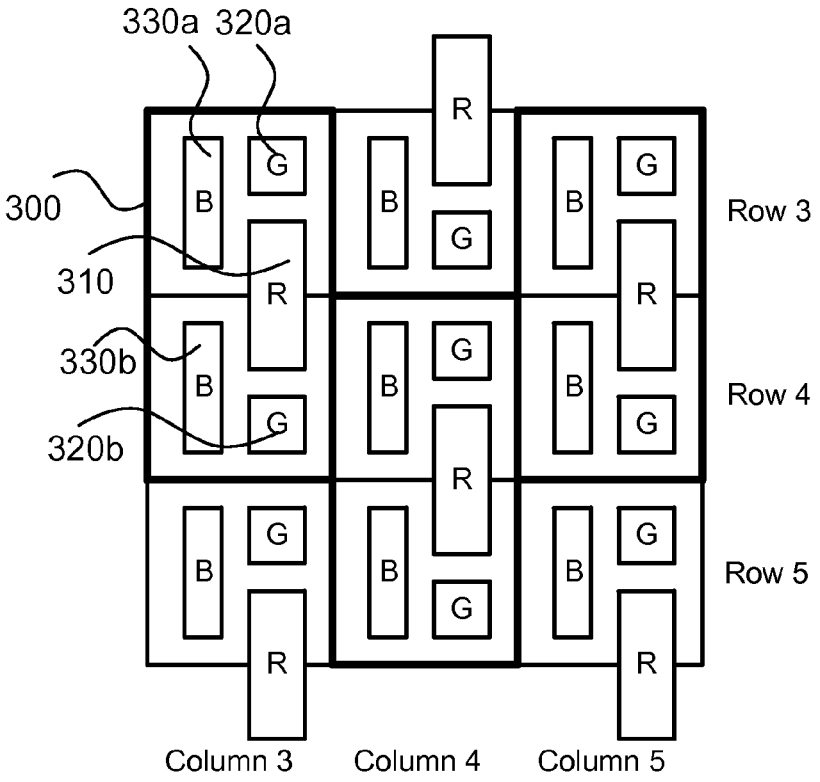
FIG. 4A shows schematically a 3×3 matrix of the pixels according to one embodiment of the disclosure.
Figure 4B:
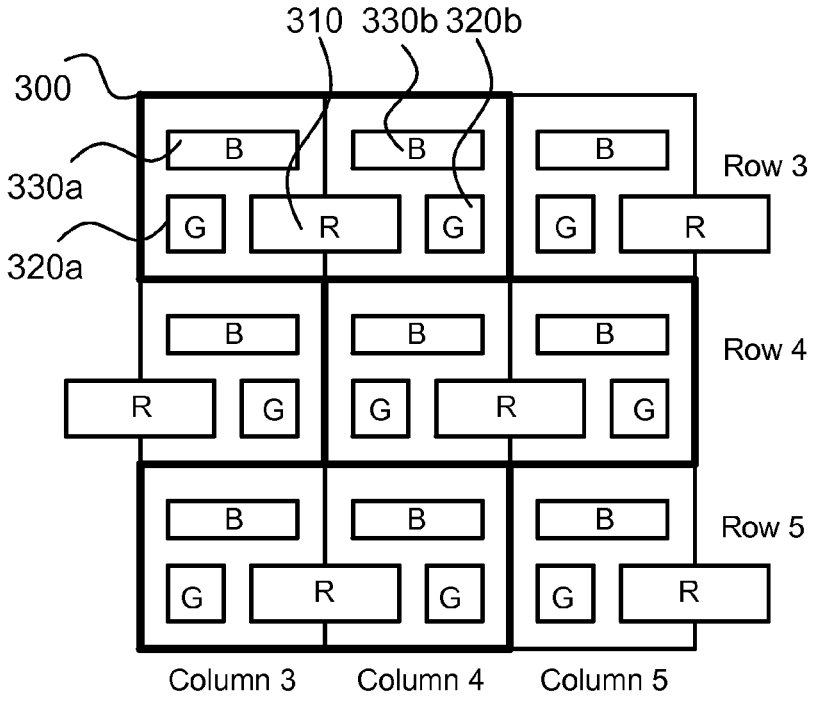
FIG. 4B shows schematically a 3×3 matrix of the pixels according to another embodiment of the disclosure.

It should be appreciated that the first, second and third colors may be in any combination of three colors, such as the three primary colors of the RGB color model. For example, FIG. 4A to FIG. 4B show two embodiments of the disclosure. FIG. 4A shows a 3×3 matrix of the pixels, which has essentially the same subpixel arrangement as that of FIG. 3A. Further, as shown in FIG. 4A, the first color is red, the second color is green, and the third color is blue. In other words, the first subpixel 310 is configured to display the red color, the second subpixels 320*a* and 320*b* are configured to display the green color, and the third subpixels 330*a* and 330*b* are configured to display the blue color.

FIG. 4B shows a 3×3 matrix of the pixels, which has essentially a transposed arrangement to that of FIG. 4A. Specifically, as shown in FIG. 4B, the j-th row of the matrix defines a plurality of pixel pairs 300, and each pixel pair 300 includes a starting pixel P(i, j) and the immediate next pixel P(i+1, j). For the starting pixel, if j is an odd integer, i is an odd integer, and if j is an even integer, i is an even integer. Specifically, for each odd row, the starting pixel of each pixel pair 300 would be in an odd column, and for each even row, the starting pixel of each pixel pair would be in an even column.

For the subpixel arrangement, FIG. 4B also shows a transposed arrangement to that of FIG. 4A. Specifically, for the pixel pair 300 including the two pixels P(3,3) and P(4,3), the pixel pair 300 has five subpixels, including a first subpixel 310, a pair of second subpixels 320*a* and 320*b*, and a pair of third subpixels 330*a* and 330*b*. In the pixel pair 300, the subpixels are positioned symmetrically. The first subpixel 310 is configured to display a first color, and is symmetrically positioned across the pixels P(3,3) and P(4,3). The second subpixels 320*a* and 320*b* are configured to display a second color, and are symmetrically positioned in the pixels P(3,3) and P(4,3), respectively. The third subpixels 330*a* and 330*b* are configured to display a third color, and are symmetrically positioned in the pixels P(3,3) and P(4,3), respectively. The first subpixel 310 is positioned between the pair of second subpixels 320*a* and 320*b*. Thus, the first subpixel 310 is substantially aligned to the second subpixels 320*a* and 320*b*. As shown in FIG. 4B, the first color is the red color, the second color is green, and the third color is blue. In other words, the first subpixel 310 is configured to display the red color, the second subpixels 320*a* and 320*b* are configured to display the green color, and the third subpixels 330*a* and 330*b* are configured to display the blue color.

Further, for the pixel pair 300, each subpixel has a length along the row and a width along the column. Specifically, the first subpixel 310 has a first length along the row and a first width along the column. Each of the second subpixels 320*a* and 320*b* has a second length along the row and a second width along the column, where the second length is shorter than the first length. Each of the third subpixels 330*a* and 330*b* has a third length along the row and a third width along the column, where the third length is greater than the second length.

Figure 5A:
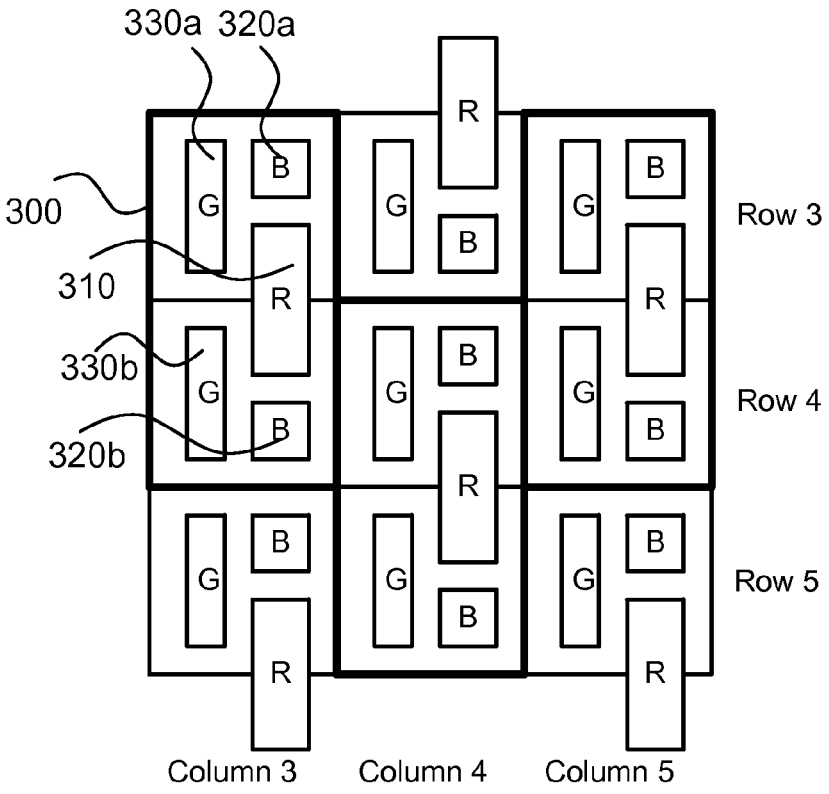
FIG. 5A shows schematically a 3×3 matrix of the pixels according to a further embodiment of the disclosure.
Figure 5B:
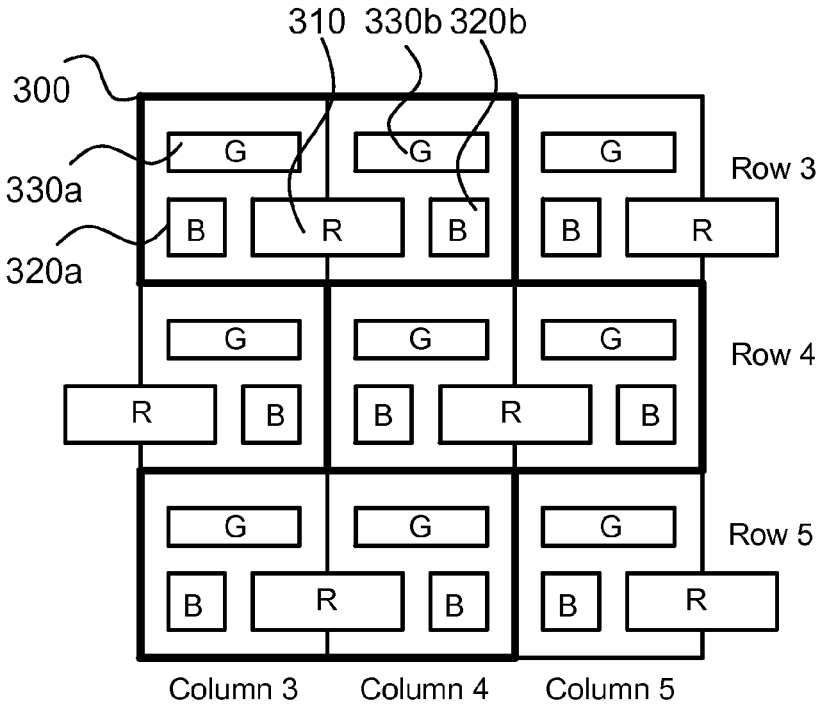
FIG. 5B shows schematically a 3×3 matrix of the pixels according to another embodiment of the disclosure.

FIG. 5A to FIG. 5B show two further embodiments of the disclosure. FIG. 5A shows a 3×3 matrix of the pixels, which has essentially the same subpixel arrangement as that of FIG. 4A. FIG. 5B shows a 3×3 matrix of the pixels, which has essentially the same subpixel arrangement as that of FIG. 4B. As shown in FIGS. 5A and 5B, the first color is red, the second color is blue, and the third color is green. In other words, the first subpixel 310 is configured to display the red color, the second subpixels 320*a* and 320*b* are configured to display the blue color, and the third subpixels 330*a* and 330*b* are configured to display the green color.

Figure 6A:
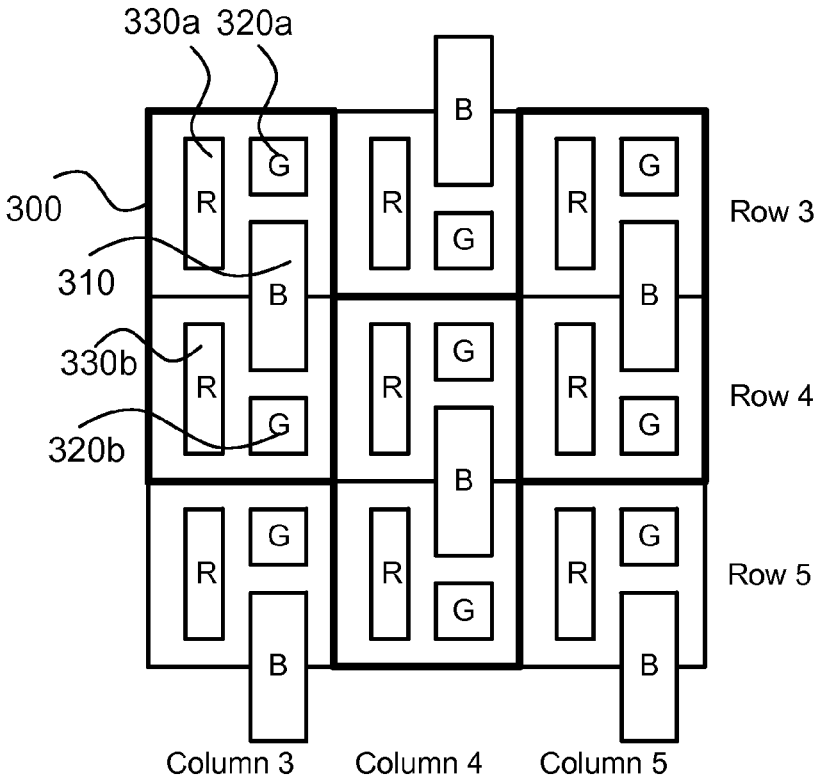
FIG. 6A shows schematically a 3×3 matrix of the pixels according to a further embodiment of the disclosure.
Figure 6B:
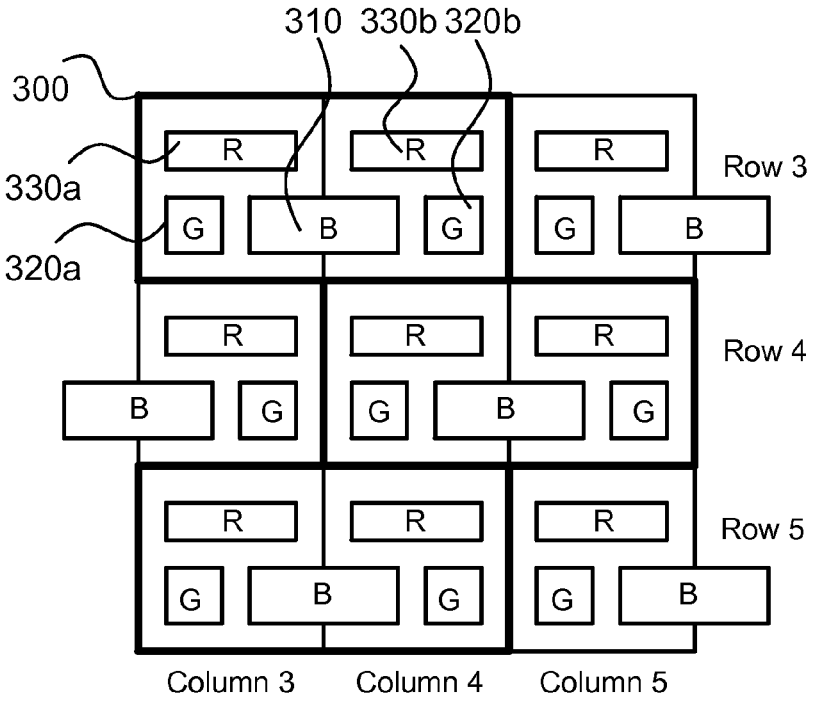
FIG. 6B shows schematically a 3×3 matrix of the pixels according to another embodiment of the disclosure.

FIG. 6A to FIG. 6B show two further embodiments of the disclosure. FIG. 6A shows a 3×3 matrix of the pixels, which has essentially the same subpixel arrangement as that of FIG. 4A. FIG. 6B shows a 3×3 matrix of the pixels, which has essentially the same subpixel arrangement as that of FIG. 4B. As shown in FIGS. 6A and 6B, the first color is blue, the second color is green, and the third color is red. In other words, the first subpixel 310 is configured to display the blue color, the second subpixels 320*a* and 320*b* are configured to display the green color, and the third subpixels 330*a* and 330*b* are configured to display the red color.

Figure 7A:
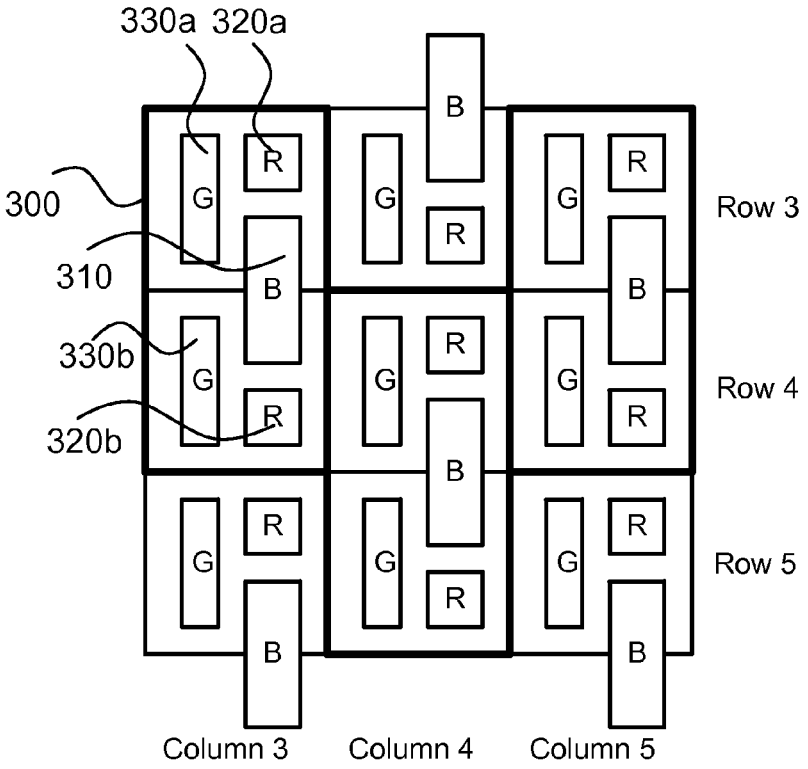
FIG. 7A shows schematically a 3×3 matrix of the pixels according to a further embodiment of the disclosure.
Figure 7B:
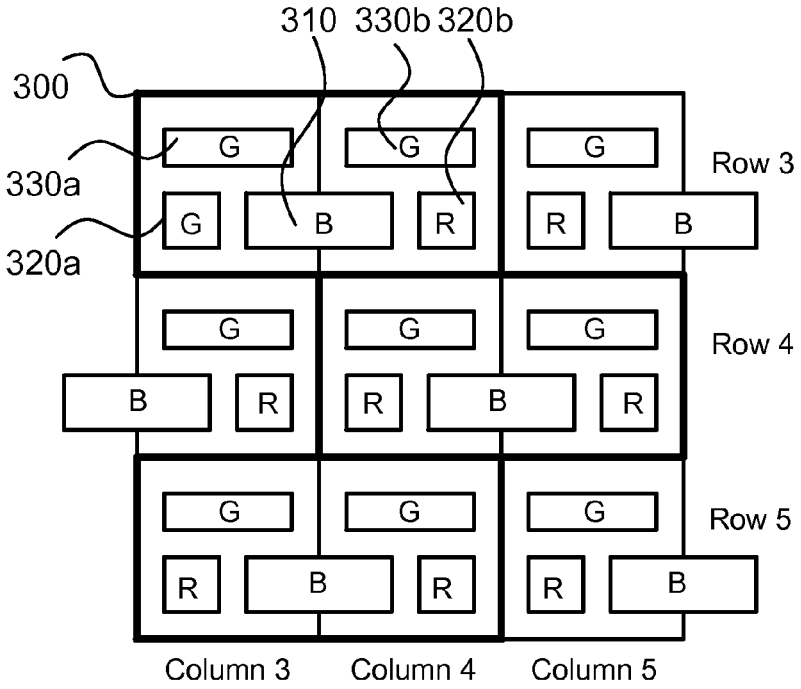
FIG. 7B shows schematically a 3×3 matrix of the pixels according to another embodiment of the disclosure.

FIG. 7A to FIG. 7B show two further embodiments of the disclosure.

FIG. 7A shows a 3×3 matrix of the pixels, which has essentially the same subpixel arrangement as that of FIG. 4A. FIG. 7B shows a 3×3 matrix of the pixels, which has essentially the same subpixel arrangement as that of FIG. 4B. As shown in FIGS. 7A and 7B, the first color is blue, the second color is red, and the third color is green. In other words, the first subpixel 310 is configured to display the blue color, the second subpixels 320*a* and 320*b* are configured to display the red color, and the third subpixels 330*a* and 330*b* are configured to display the green color.

Figure 8A:
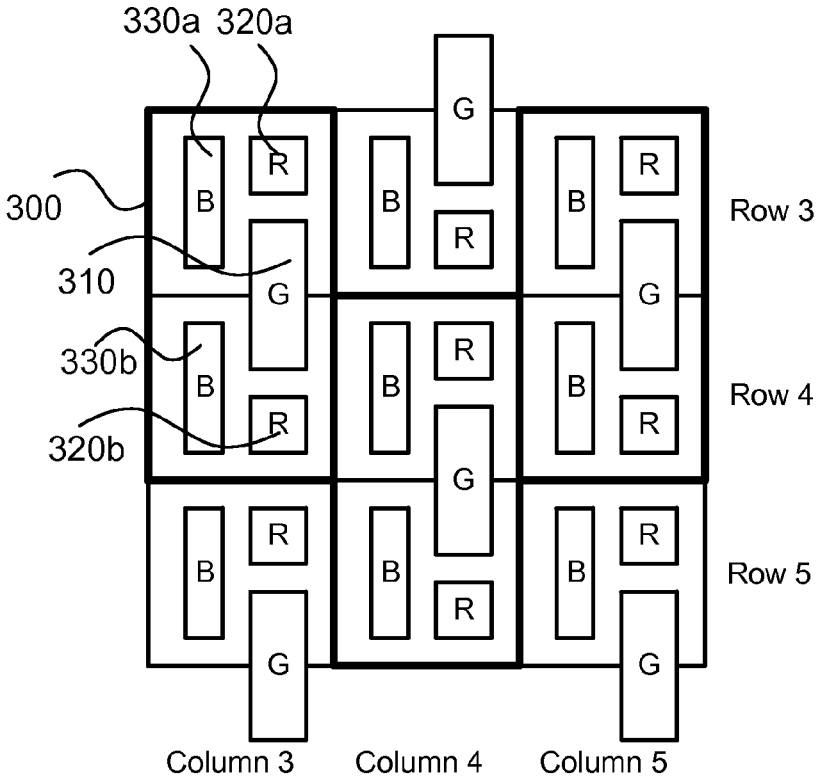
FIG. 8A shows schematically a 3×3 matrix of the pixels according to a further embodiment of the disclosure.
Figure 8B:
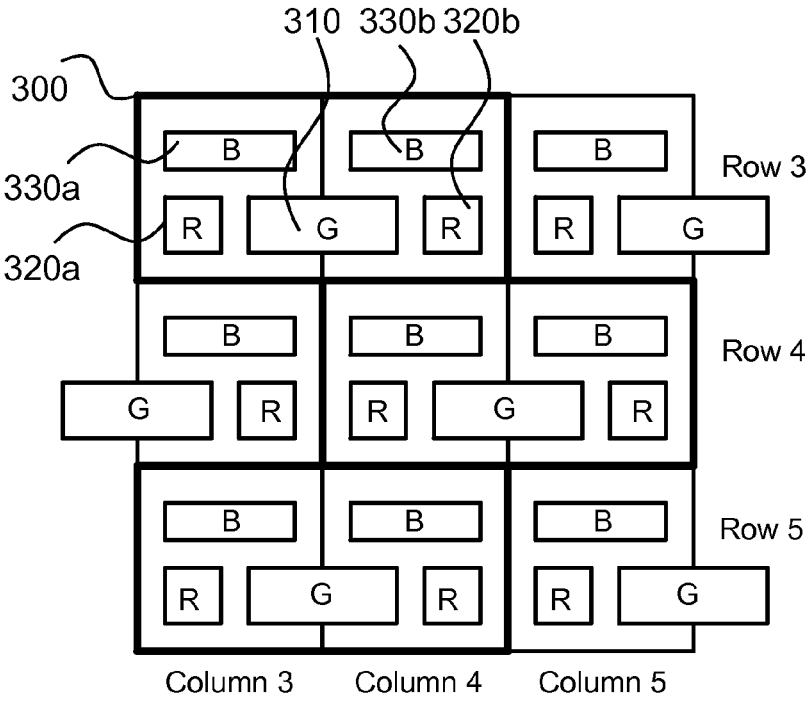
FIG. 8B shows schematically a 3×3 matrix of the pixels according to another embodiment of the disclosure.

FIG. 8A to FIG. 8B show two further embodiments of the disclosure. FIG. 8A shows a 3×3 matrix of the pixels, which has essentially the same subpixel arrangement as that of FIG. 4A. FIG. 8B shows a 3×3 matrix of the pixels, which has essentially the same subpixel arrangement as that of FIG. 4B. As shown in FIGS. 8A and 8B, the first color is green, the second color is red, and the third color is blue. In other words, the first subpixel 310 is configured to display the green color, the second subpixels 320*a* and 320*b* are configured to display the red color, and the third subpixels 330*a* and 330*b* are configured to display the blue color.

Figure 9A:
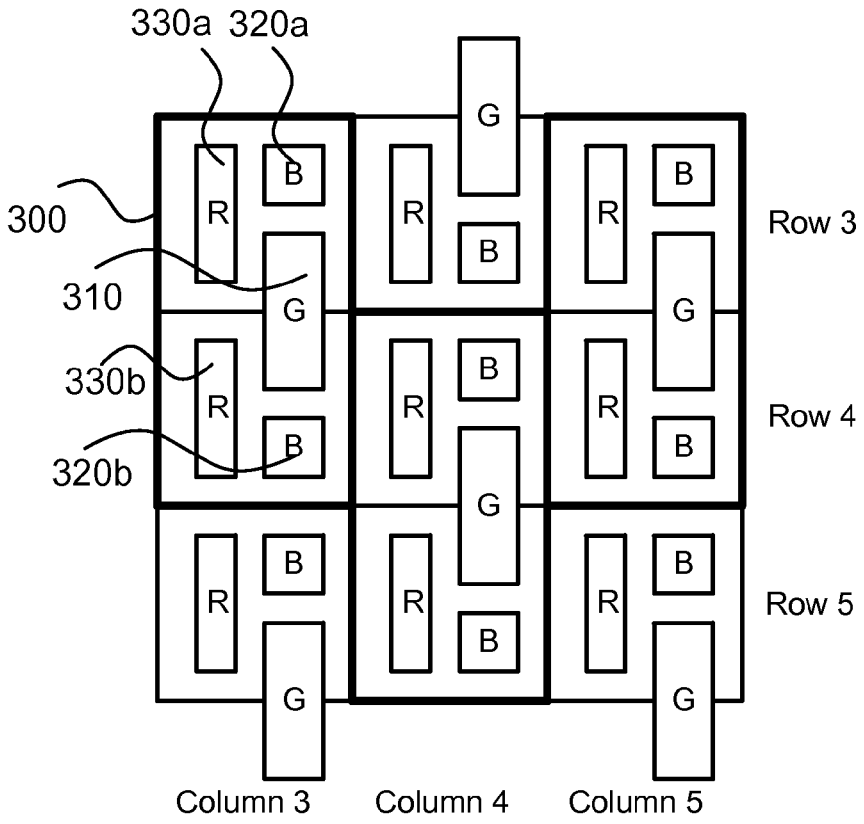
FIG. 9A shows schematically a 3×3 matrix of the pixels according to a further embodiment of the disclosure.
Figure 9B:
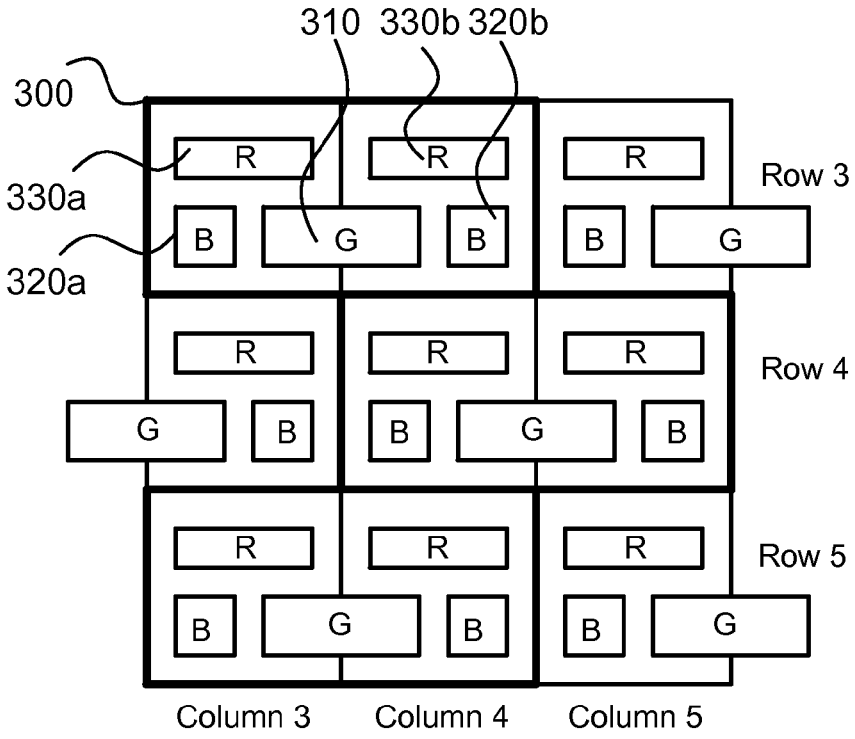
FIG. 9B shows schematically a 3×3 matrix of the pixels according to another embodiment of the disclosure.

FIG. 9A to FIG. 9B show two further embodiments of the disclosure. FIG. 9A shows a 3×3 matrix of the pixels, which has essentially the same subpixel arrangement as that of FIG. 4A. FIG. 9B shows a 3×3 matrix of the pixels, which has essentially the same subpixel arrangement as that of FIG. 4B. As shown in FIGS. 9A and 9B, the first color is green, the second color is blue, and the third color is red. In other words, the first subpixel 310 is configured to display the green color, the second subpixels 320*a* and 320*b* are configured to display the blue color, and the third subpixels 330*a* and 330*b* are configured to display the red color.

Figure 10:
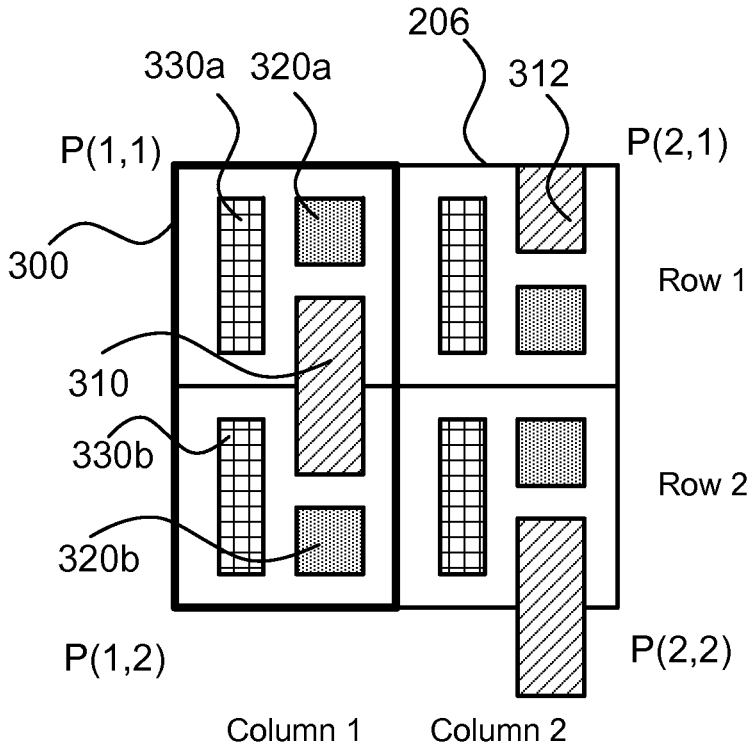
FIG. 10 shows schematically a 2×2 matrix of the pixels at the edge of the matrix according to one embodiment of the disclosure.

FIG. 10 shows schematically a 2×2 matrix of the pixels at the edge of the matrix according to one embodiment of the disclosure. As discussed above, when the pixel pair is positioned along the column as shown in FIG. 4A, for each pixel pair including the pixels P(i, j) and P(i, j+1), if i is an even integer, j is also an even integer. Thus, if i is an even integer (referring to the even columns), the first pixel P(i, 1) of the column at the edge 206 and the last pixel P(i, N) of the column at the edge 208 would have no pixel to pair with. For example, as shown in FIG. 10, for column 2, the pixel P(2,1) would have no pixel to pair with. For such pixel, the first subpixel cannot be positioned across the pixels of the pixel pair. Thus, the first pixel P(i, 1) and the last pixel P(i, N) would each have three subpixels, including the first subpixel 312, the second subpixel 320, and the third subpixel 330. The first subpixel 312 is positioned at the edge of the matrix. The second subpixel 320 and the third subpixel 330 are positioned in a similar way as in a virtual pixel pair. Similarly, when the pixel pair is positioned along the row as shown in FIG. 4B, for each pixel pair including the pixels P(i, j) and P(i+1, j), if j is an even integer, i is also an even integer. Thus, if j is an even integer (referring to the even rows), the first pixel P(1, j) of the column at the edge 202 and the last pixel P(M, j) of the column at the edge 204 would have no pixel to pair with. Thus, the first pixel P(1, j) and the last pixel P(M, j) would each have three subpixels, including the first subpixel positioned at the edge of the matrix, the second subpixel, and the third subpixel. The second subpixel and the third subpixel are positioned in a similar way as in a virtual pixel pair.

The color display apparatus as recited in the disclosure may be any color display devices using subpixels to display colors. In certain embodiments, the color display apparatus may be a color AMOLED, or any other color display devices.

In sum, aspects of the disclosure, among other things, recite color display apparatuses. In one embodiment, the color display apparatus includes a plurality of pixels P(i, j) arranged in a matrix having M columns and N rows, where i=1, 2, . . . , M, j=1, 2 . . . , N, and M and N are positive integers. A plurality of pixel pairs is defined along either the columns or the rows, and each pixel pair includes one pixel P(i, j) and the next immediate pixel, where if i is an odd integer, j is an odd integer, and if i is an even integer, j is an even integer. Each pixel pair has five subpixels, including a first subpixel configured to display a first color and symmetrically positioned across the pixels, a pair of second subpixels configured to display a second color and symmetrically positioned in the pixels respectively, and a pair of third subpixels configured to display a third color and symmetrically positioned in the pixels respectively, where the first subpixel is positioned between the pair of second subpixels.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A color display apparatus, comprising:

a plurality of pixels P(i, j) arranged in a matrix having M columns and N rows, wherein i=1, 2, . . . , M, j=1, 2 . . . , N, and M and N are positive integers, wherein the i-th column of the matrix defines a plurality of pixel pairs, each pixel pair comprising two pixels P(i, j) and P(i, j+1), wherein if i is an odd integer, j is an odd integer, and if i is an even integer, j is an even integer, wherein each pixel pair has five subpixels, comprising a first subpixel configured to display a first color and symmetrically positioned across the pixels P(i, j) and P(i, j+1), a pair of second subpixels configured to display a second color and symmetrically positioned in the pixels P(i, j) and P(i, j+1), respectively, and a pair of third subpixels configured to display a third color and symmetrically positioned in the pixels P(i, j) and P(i, j+1), respectively, wherein the first subpixel is positioned between the pair of second subpixels; and wherein, for each pixel pair:

the first subpixel has a first length along the column and a first width along the row;

each second subpixel has a second length along the column and a second width along the row, wherein the second length is shorter than the first length; and each third subpixel has a third length along the column and a third width along the row, wherein the third length is greater than the second length.

2. The color display apparatus of claim 1, being a color active-matrix organic light-emitting diode (AMOLED).

3. The color display apparatus of claim 1, wherein if i is an even integer, a first pixel P(i, 1) and a last pixel P(i, N) of the i-th column each has three subpixels, comprising the first subpixel positioned at an edge of the matrix, the second subpixel, and the third subpixel.

4. The color display apparatus of claim 1, wherein the first color is blue, the second color is green, and the third color is red.

5. The color display apparatus of claim 1, wherein the first color is blue, the second color is red, and the third color is green.

6. The color display apparatus of claim 1, wherein the first color is red, the second color is green, and the third color is blue.

7. The color display apparatus of claim 1, wherein the first color is red, the second color is blue, and the third color is green.

8. The color display apparatus of claim 1, wherein the first color is green, the second color is blue, and the third color is red.

9. The color display apparatus of claim 1, wherein the first color is green, the second color is red, and the third color is blue.

10. A color display apparatus, comprising:

a plurality of pixels P(i, j) arranged in a matrix having M columns and N rows, wherein i=1, 2, . . . , M, j=1, 2 . . . , N, and M and N are positive integers, wherein the j-th row of the matrix defines a plurality of pixel pairs, each pixel pair comprising two pixels P(i, j) and P(i+1, j), wherein if i is an odd integer, j is an odd integer, and if i is an even integer, j is an even integer, wherein each pixel pair has five subpixels, comprising a first subpixel configured to display a first color and symmetrically positioned across the pixels P(i, j) and P(i+1, j), a pair of second subpixels configured to display a second color and symmetrically positioned in the pixels P(i, j) and P(i+1, j), respectively, and a pair of third subpixels configured to display a third color and symmetrically positioned in the pixels P(i, j) and P(i+1, j), respectively, wherein the first subpixel is positioned between the pair of second subpixels; and wherein, for each pixel pair:

the first subpixel has a first length along the row and a first width along the column;

each second subpixel has a second length along the row and a second width along the column, wherein the second length is shorter than the first length; and each third subpixel has a third length along the row and a third width along the column, wherein the third length is greater than the second length.

11. The color display apparatus of claim 10, being a color active-matrix organic light-emitting diode (AMOLED).

12. The color display apparatus of claim 10, wherein if j is an even integer, a first pixel P(1, j) and a last pixel P(M, j) of the j-th row each has three subpixels, comprising the first subpixel positioned at an edge of the matrix, the second subpixel, and the third subpixel.

13. The color display apparatus of claim 10, wherein the first color is blue, the second color is green, and the third color is red.

14. The color display apparatus of claim 10, wherein the first color is blue, the second color is red, and the third color is green.

15. The color display apparatus of claim 10, wherein the first color is red, the second color is green, and the third color is blue.

16. The color display apparatus of claim 10, wherein the first color is red, the second color is blue, and the third color is green.

17. The color display apparatus of claim 10, wherein the first color is green, the second color is blue, and the third color is red.

18. The color display apparatus of claim 10, wherein the first color is green, the second color is red, and the third color is blue.

* * * * *